US006988715B2

(12) United States Patent
Winter et al.

(10) Patent No.: US 6,988,715 B2
(45) Date of Patent: Jan. 24, 2006

(54) HOISTING DEVICE

(75) Inventors: Klaus-Jürgen Winter, Wetter (DE); Heinrich Flaig, Bochum (DE); Thomas Kohlenberg, Soest (DE); Michael Dammer, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 88 days.

(21) Appl. No.: 10/840,985

(22) Filed: May 7, 2004

(65) Prior Publication Data

US 2004/0238805 A1 Dec. 2, 2004

(30) Foreign Application Priority Data

May 9, 2003 (DE) ..... 103 20 853

(51) Int. Cl.
*B65D 1/26* (2006.01)

(52) U.S. Cl. ..... 254/278; 464/51

(58) Field of Classification Search ..... 254/266, 254/278; 464/32, 41, 45, 51, 70, 80–83, 464/85, 92

See application file for complete search history.

(56) References Cited

U.S. PATENT DOCUMENTS 3,744,760 A * 7/1973 Uher ..... 254/351
3,799,005 A * 3/1974 Koehler ..... 475/12
4,483,685 A * 11/1984 Spasiano et al. ..... 464/83
4,714,448 A * 12/1987 Focqueur et al. ..... 464/68.91
4,795,402 A * 1/1989 Reichardt ..... 464/74
5,474,499 A * 12/1995 Olson ..... 464/83
5,697,261 A * 12/1997 Mokdad et al. ..... 74/574.4
5,950,778 A * 9/1999 Mahoney et al. ..... 188/378
6,578,674 B2 * 6/2003 Doran ..... 187/277
6,875,112 B2 * 4/2005 te Uhle et al. ..... 464/83

FOREIGN PATENT DOCUMENTS

DE 29816675 U1 2/1999

* cited by examiner

*Primary Examiner*—Emmanuel Marcelo
(74) *Attorney, Agent, or Firm*—Van Dyke, Gardner, Linn & Burkhart, LLP

(57) ABSTRACT

The invention concerns a hoisting device with a drive unit (1) including a motor and a transmission, a drive shaft (2) which can be driven by the drive unit (1), with drive flange (3) which can be secured to it, as well as a cable drum (4) which can be connected to the drive flange (3), wherein the torque of the drive shaft (2) can be transmitted by a coupling to the cable drum (4), wherein the coupling consists of at least one coupling element (9) arranged essentially by form fitting between the drive flange (3) and the cable drum (4), being constructed from individual coupling segments **(9*a*), which have drive cams (10) pointing radially inward and outward on both sides, which engage with corresponding recesses (11) of the two adjoining structural parts (3, 4)** that can be coupled together for the torque transmission.

In order to create a hoisting device whose coupling reliably equalizes the alignment errors with a simple and space-saving construction, the invention proposes that the coupling segments **(9*a*) be arranged on the drive cams (10) and extend essentially between the drive flange (3) and the cable drum (4)**.

30 Claims, 6 Drawing Sheets

HOISTING DEVICE

BACKGROUND OF THE INVENTION

The invention concerns a hoisting device with a drive unit consisting of a motor and a transmission, a drive shaft which can be driven by the drive unit, with a drive flange which can be secured to it, and a cable drum which can be connected to the drive flange, wherein the torque of the drive shaft can be transmitted to the cable drum across a coupling.

Hoisting devices configured as a cable string basically comprise cylindrical cable drums, which are mounted so as to turn in a frame. The cable drum is driven by means of a gear motor, the output shaft of the transmission being coupled torsion-free to the cable drum. In order to equalize the manufacturing tolerances and alignment errors of the cable drum, which is generally outfitted with a so-called "three-point bearing", such as might lead to strains in the drive system, it is known from practice how to arrange a coupling between the output shaft and the cable drum in a manner that can take up these alignment errors.

In the so-called Zapex coupling, the coupling is fashioned as a toothed coupling, which comprises a pinion joined torsion-free to the output shaft and a toothed rim meshing with this pinion and secured to the drive flange of the cable drum.

Furthermore, the so-called TGL coupling is known, in which a flange secured torsion-free to the output shaft engages by one or more driving lugs with recesses in an end wall of the cable drum.

Both coupling mechanisms have become quite common in practice, although they have the drawback that they are relatively costly for mass-produced lifting mechanisms with relatively low drum torque and furthermore they cannot be used with small drum diameters, for space considerations owing to their size.

DE 298 16 675 U1 discloses a coupling for lifting mechanisms for transmitting the torque of a driven transmission shaft to a cable drum, with a coupling hub arranged at one end of the transmission shaft and with a coupling housing arranged on the coupling hub and enclosed by inner and outer covers. The coupling housing and the coupling hub are form-fitted together by circular gearings formed on the coupling housing and the coupling hub, and in the bores formed by the two circular gearings there are arranged barrel rollers to transmit the force.

SUMMARY OF THE INVENTION

Starting with this, the task of the invention is to furnish a hoisting device of the kind mentioned above with a coupling of simple and space-saving construction, ensuring a coupling of the cable drum to the drive shaft while equalizing the alignment errors.

The solution to this problem is characterized according to the invention in that the coupling segments extend outside the drive cams, essentially between the drive flange and the cable drum.

Due to the invented configuration of the coupling as coupling segments to be arranged in form-fitting manner and thereby transmitting the torque between the engaging structural parts, it is possible to configure the clutch with simple construction and cost benefits.

Furthermore, the possibility exists of arranging the clutch in various locations, namely, between the drive flange and the cable drum and/or between the drive shaft and the drive flange.

When arranging the coupling element between the drive flange and the cable drum, the drive shaft and the drive flange must then be joined together torsion-free, in order to be able to transmit the torque of the drive shaft via the coupling to the cable drum.

The torque transmission of the structural parts coupled together occurs, in one practical embodiment of the invention, in that the coupling element has drive cams pointing radially inward and outward on both sides, each of which engage with corresponding recesses in the two adjoining structural parts being coupled together for the torque transmission.

According to the invention, at least one coupling element forming the coupling is constructed to consist of individual coupling segments. The construction from individual coupling segments enables the equalization of manufacturing tolerances in a simple manner.

The coupling segments for the placement between the drive flange and the cable drum preferably have pieces forming bearing surfaces extending in two dimensions from the drive cams. In this way, it is possible to mount the cable drum onto the drive flange by means of the pieces of the coupling segments.

In one embodiment of the invention, the individual coupling segments extend around the drive cams on both sides, i.e., in the circumferential direction of the drive flange.

Advantageously, the individual coupling segments extend in a circular arc between the drive flange and the cable drum.

According to a first embodiment for the configuration of the coupling segments, individual coupling segments are joined together by elastic connectors, so that a single coupling segment is formed consisting of several coupling segments, which can be fabricated and assembled in an especially simple and economical manner.

A second embodiment for the configuration of the coupling segments proposes that individual coupling segments can be coupled together by means of molded-on projections and correspondingly fashioned seats. The projections and seats can be configured so as to enable either an interlocking coupling or also a pure form-fitting coupling of the individual coupling segments to each other.

In a third embodiment of the invention, the coupling element finally consists of individual coupling segments arranged at a distance from each other.

In order to assure a uniform transmission of torque, on the one hand, and reduce the mechanical loads on the individual coupling segments, on the other hand, the invention proposes that each coupling segment have drive cams pointing radially outward on both sides, which engage in corresponding recesses of the two adjoining structural parts being coupled together to transmit the torque. Advantageously, the drive cams are arranged on the coupling segments pointing radially outward and inward, directly opposite each other.

Since the drive cams essentially determining the torque transmission are subjected to intense shear stress, according to a preferred embodiment of the invention it is proposed that the drive cams consist at least partially of a harder material than the rest of the coupling element and preferably contain a shear-resistant core.

A length mismatch between the cable drum and the drive shaft can be equalized according to the invention in that the recesses to accommodate the drive cams of at least one of the structural parts being coupled together are configured to be larger, looking in the axial direction of the cable drum than the corresponding drive cams being accommodated.

Furthermore, in order to equalize an angle mismatch between the lengthwise axis of the cable drum and the drive shaft, the invention proposes that at least one bearing surface of the coupling element at one of the structural parts being coupled together and/or at least one bearing surface of a structural part being coupled at the coupling element be made convex or outwardly arched.

Finally, the invention proposes that the at least one coupling element consist at least partly of an elastic material, especially a plastic material. The elasticity of the material enables an additional equalization of possible stresses, and additional dampening properties can be achieved by an appropriate choice of material, in order to lessen the impact loading of the cable tension on the drive shaft.

Additional features and benefits of the invention will be evident from the corresponding drawing, which represents different sample embodiments of a hoisting device according to the invention, merely as examples.

DETAILED DESCRIPTION OF THE PREFERRED EMBODIMENT

Figure 1:
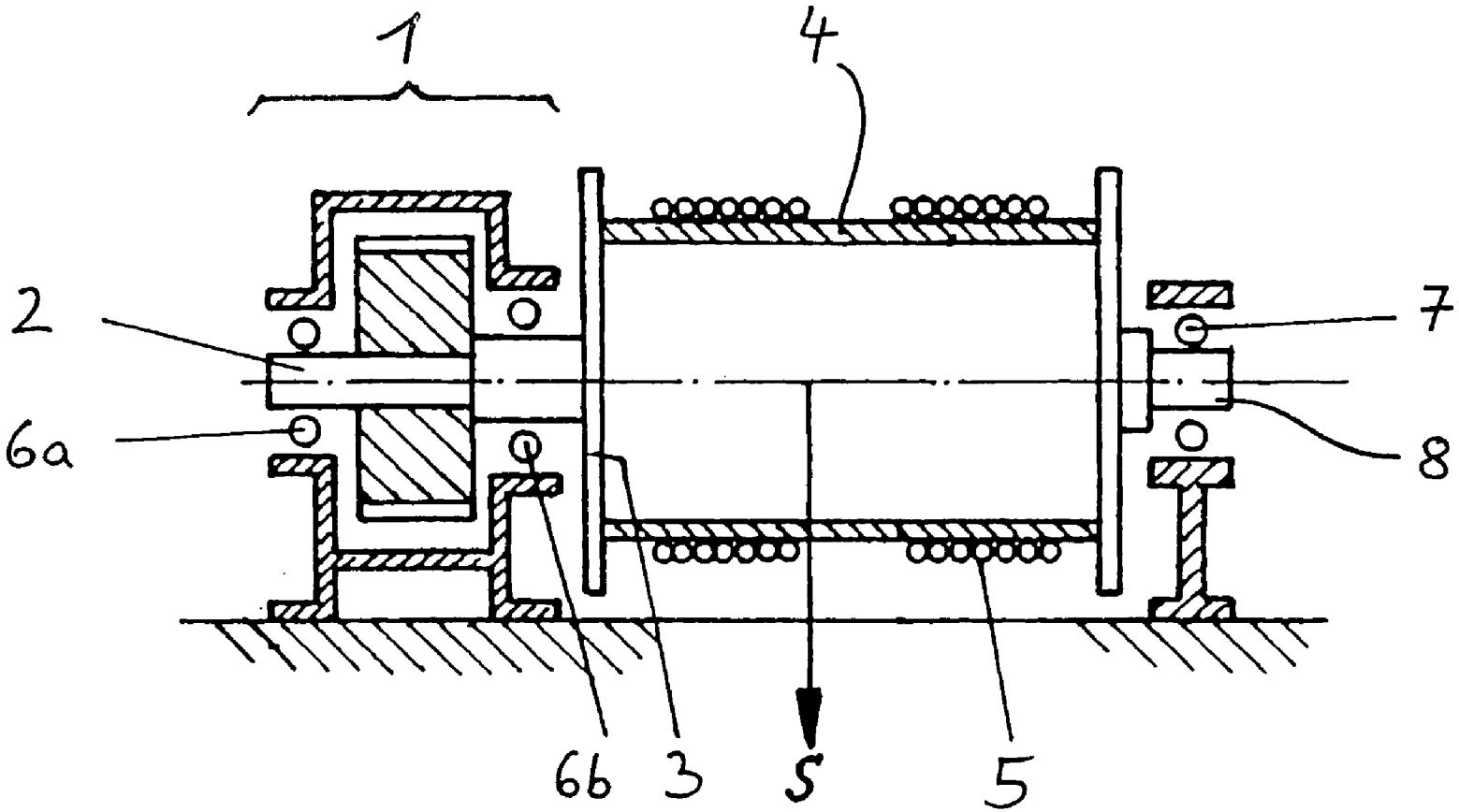
FIG. 1 is a sectional view taken lengthwise through the construction of a hoisting device according to the invention.

FIG. 1 shows schematically the construction of a hoisting device configured as a cable pull. The hoisting device essentially comprises a drive unit 1, consisting of a motor and a transmission, a drive shaft 2 which can be driven by the drive unit 1, with drive flange 3 which can be secured to it, as well as a cable drum 4 which can be connected torsion-free to the drive flange 3, on which the cable 5, shown only schematically, can be wound up or paid out.

As is evident from FIG. 1, the cable drum 4 is outfitted with a so-called "three-point bearing", in which the cable drum 4 is mounted by means of two bearings 6*a*, 6*b* at the ends of the drive shaft 2 and one bearing 7 at a drum journal 8 opposite the drive shaft 2.

Since, in practice, these bearings 6*a*, 6*b* and 7 cannot be arranged in exact alignment due to manufacturing and setup tolerances and deformations under load, secondary bearing stresses occur in the mounted parts, namely, in the drive shaft 2 and/or in the drive flange 3 of the cable drum 4. In order to avoid these unwanted and hard to predict stresses, which arise in addition to a payload acting as the cable tension force S, a coupling is provided, which transmits the torque of the drive shaft 2 to the cable drum 4 with angular movement and length equalization, as represented in FIG. 2*a*.

Figure 2A:
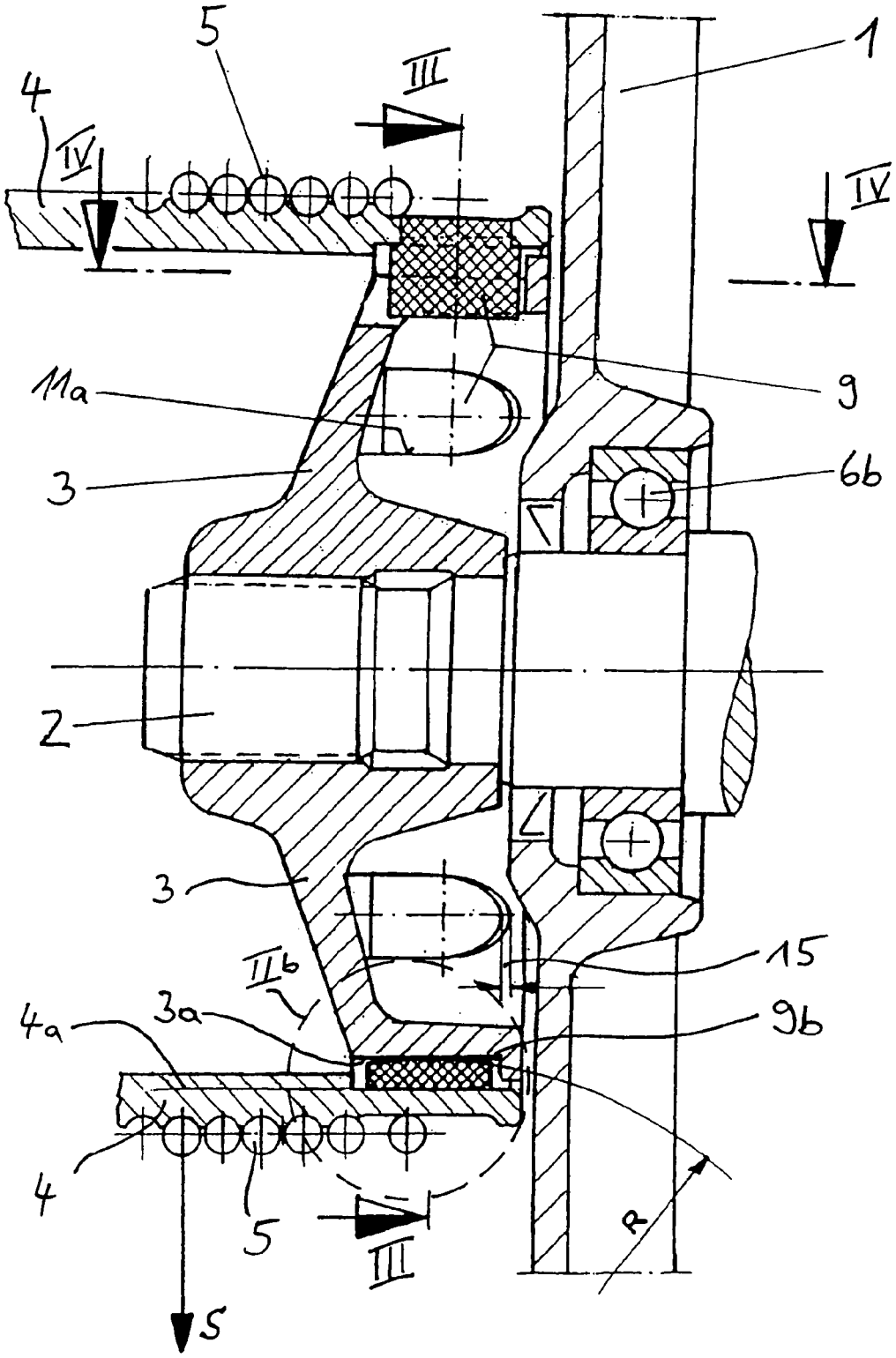
FIG. 2*a* is a partial sectional view taken lengthwise through the coupling region of a hoisting device according to the invention.

In the embodiment represented in FIG. 2*a*, the coupling is arranged between the drive flange 3 and the cable drum 4, while the drive flange 3 for its part is joined torsion-free to the drive shaft 2. Of course, it is also possible to arrange the coupling between drive shaft 2 and the drive flange 3, but in this case it is necessary for the drive flange 3 to be joined torsion-free to the cable drum 4. As a third embodiment of the coupling, the possibility exists of accomplishing the torque transmission both from the drive shaft 2 to the drive flange 3 and from the drive flange 3 to the cable drum 4 by means of a single coupling.

Figure 3:
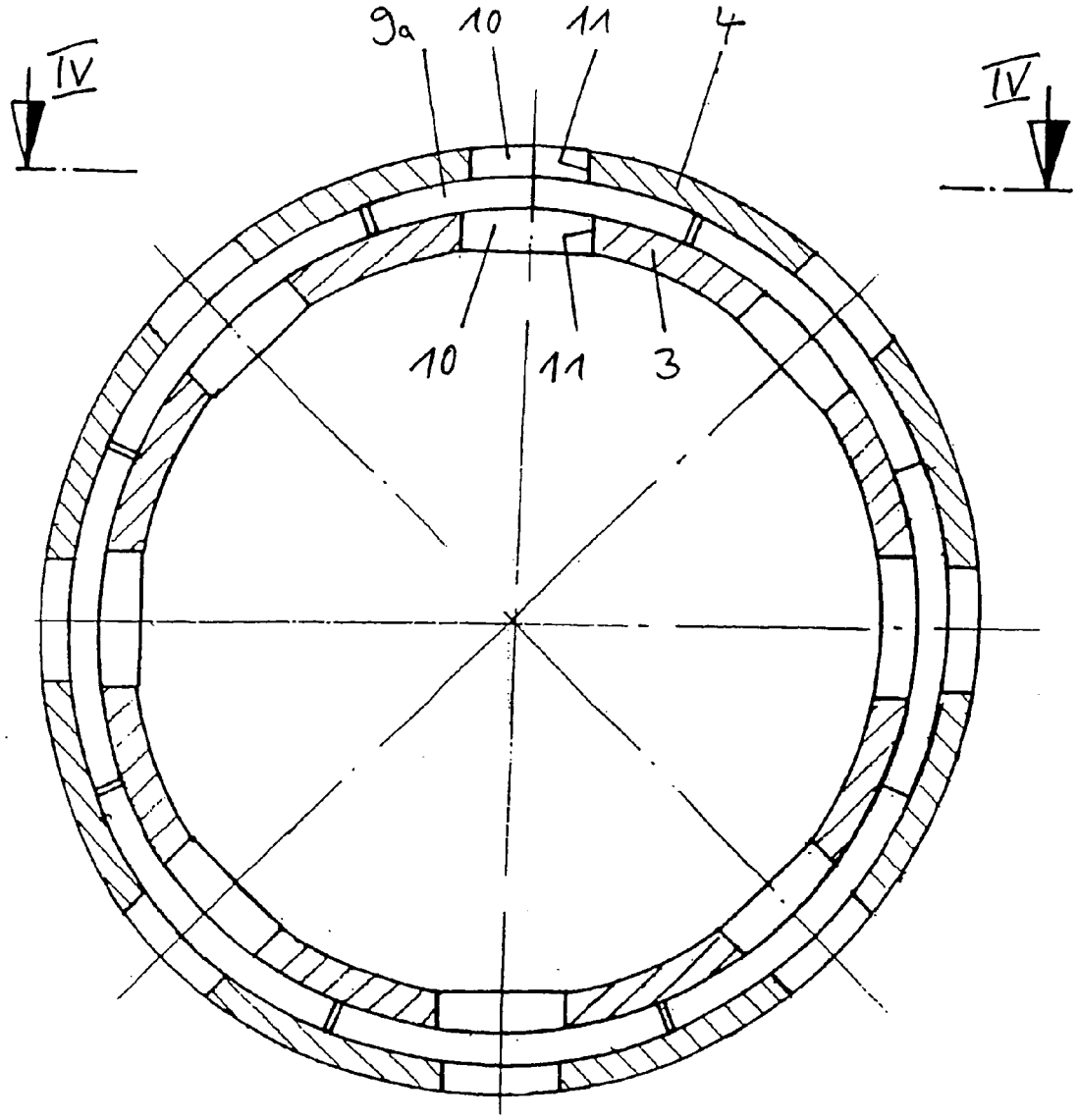
FIG. 3 is a sectional view taken along line III—III of FIG. 2.

As is evident from the section view of FIG. 3, the coupling arranged between the drive flange 3 and the cable drum 4 consists of a coupling element 9 having several individual coupling segments 9*a,* which is arranged essentially form-fitting between the two structural parts 3, 4 being coupled together. The precise construction of the coupling element 9 and the coupling segments 9*a* will be described hereafter with FIGS. 5*a* through 5*c*.

FIG. 3 shows, furthermore, that each coupling segment 9*a* of the coupling element 9 has drive cams 10 pointing radially inward and outward on both sides, which engage with corresponding recesses 11 of the drive flange 3 and the cable drum 4 in order to transmit the torque. In the sample embodiments depicted, the drive cams 10 are always arranged directly opposite each other on the coupling segments 9*a* and pointing radially inward and outward. Of course, it is also possible to arrange the drive cams 10 of both sides of a coupling segment 9*a* staggered from each other on a coupling segment 9*a*.

The coupling elements 9*a* extend in a circular arc in the space between the drive shaft 3 and the cable drum 4, and they broaden out two-dimensionally in the peripheral direction around the drive cams 10 on both sides, in order to form pieces 9*c* producing bearing surfaces 9*b*, on which the cable drum 4 rests.

Figures 5A, 5B, 5C:
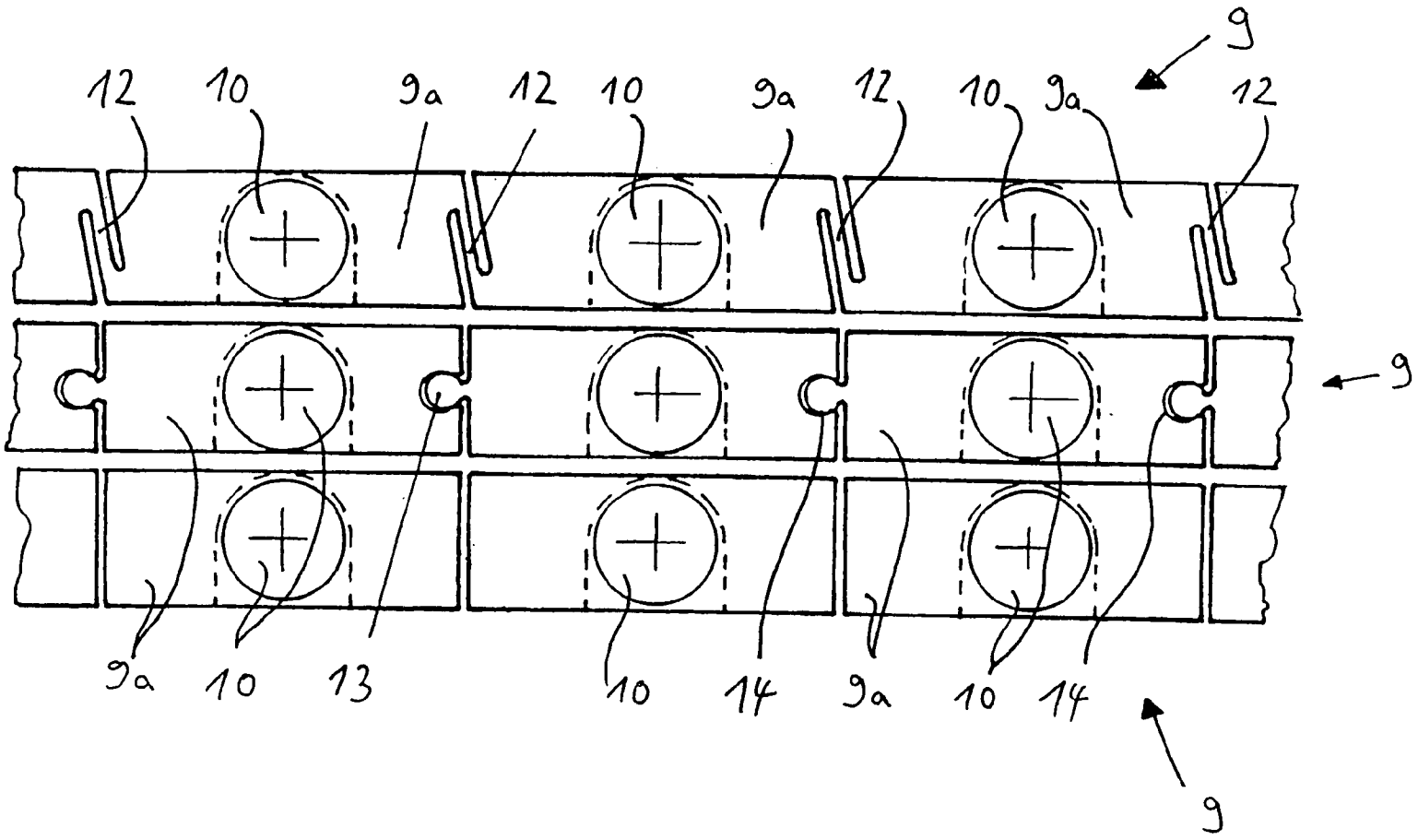
FIG. 5*a* is a top view of a coupling element according to a first embodiment of the invention.
FIG. 5*b* is the same view as FIG. 5*a,* but showing a second embodiment of a coupling element according to the invention.
FIG. 5*c* is the same view as FIG. 5*a,* but showing a third embodiment of a coupling element according to the invention.

The pictures of FIG. 5*a* through 5*c,* finally, show three embodiments for configuring the coupling elements 9 made from individual coupling segments 9*a*. In the first embodiment shown in FIG. 5*a*, the coupling element 9 is fashioned almost as a single piece, while the individual coupling segments 9*a* are joined together by elastic connectors 12.

In the second embodiment per FIG. 5*b*, each coupling segment 9*a* has molded-on projections 13 and seats 14 formed corresponding to the projections 13, by which individual coupling segments 9*a* can be coupled together. While the sample embodiment depicted represents an interlocking coupling, the projections 13 and seats 14 can also be made rectangular, for example, so that they are not interlocking, but only engage with each other essentially by form fitting.

The coupling element 9 of the third embodiment represented in FIG. 5*c* consists of individual coupling segments 9*a* arranged at a distance from each other. These three variants depicted enable a length adjustment between the individual drive cams 10 and the corresponding seats 11 and, thus, a uniform distribution of the cable tension force S among the individual coupling segments 9*a*.

Since the coupling segments 9*a* are exposed to a strong shear strain in the region of the drive cams 10 transmitting the torque to the other part, it is advantageous to configure the drive cams 10 at least partly from a harder material than the rest of the coupling element 9.

Figure 6:
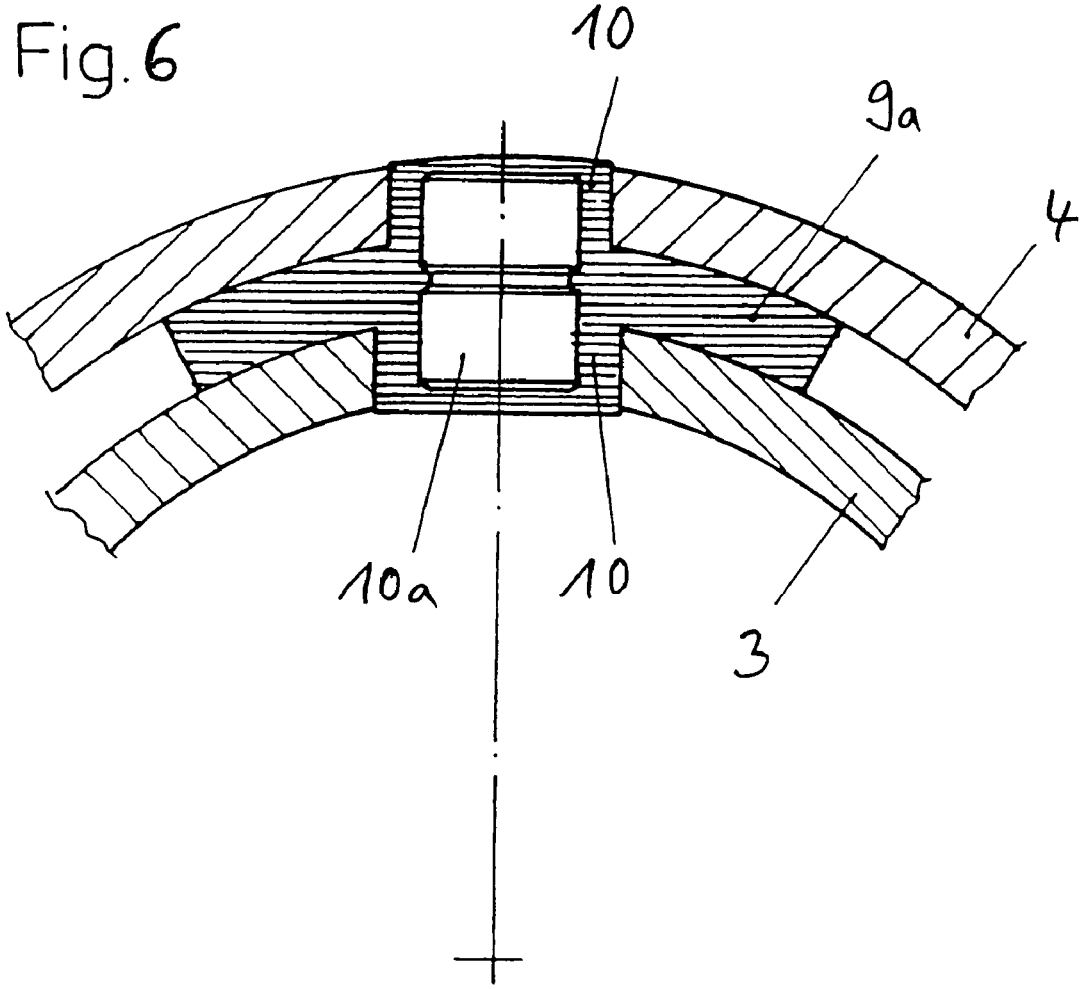
FIG. 6 is a sectional view taken along line VI—VI of FIG. 3.

According to FIG. 6, for this purpose the drive cams 10 contain a shear-resistant core 10*a,* which can be made of metal, for example; the remaining coupling segment 9*a* is then made from plastic. Fundamentally, it is also possible to use castable metals, such as bronze alloys, for the coupling elements 9. The shear-resistant core 10*a* can then be omitted.

These shear-resistant cores have the function of ensuring a secure torque transmission between the structural parts coupled together in event of failure of the drive cams 10—due to abrasion, for example—until the defective coupling element 9 or coupling segment 9*a* is replaced.

Figure 4:
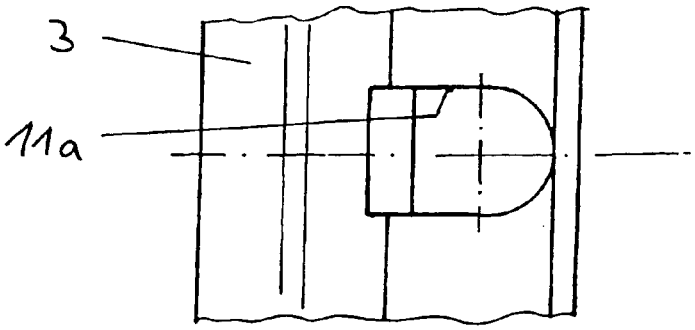
FIG. 4 is a partial sectional view taken along line IV—IV of FIG. 2.

In order to be able to equalize a length mismatch between the cable drum 4 and the drive flange 3, the recesses 11 to accommodate the drive cams 10 of the coupling segments 9*a* are fashioned in the sample embodiment depicted as lengthwise grooves 11*a* and, thus, are larger in the axial direction of the cable drum 4 than the corresponding drive cams 10 being accommodated. A gap 15 arising as a result of this configuration is noticeable especially in FIG. 2*a*, while FIG. 4 shows the configuration of a lengthwise groove 11*a*.

Figure 2B:
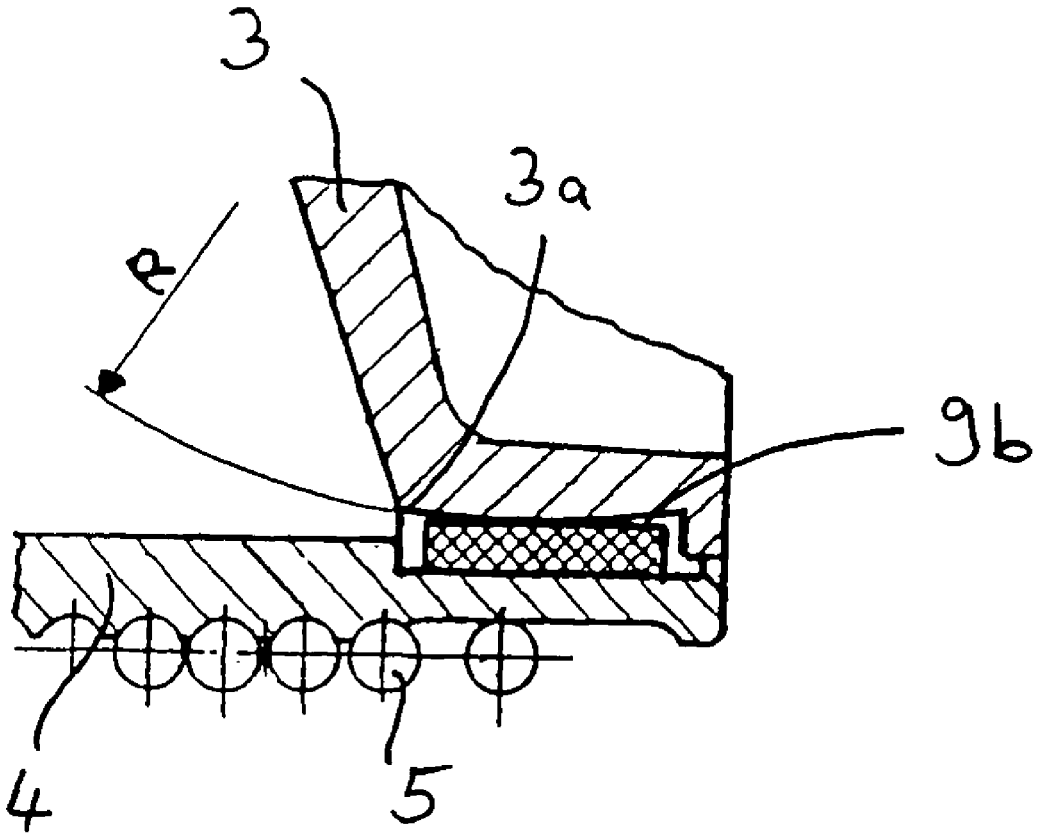
FIG. 2*b* is a view of detail IIb of FIG. 2*a,* but showing an alternative configuration.

FIGS. 2*a* and 2*b* show how an angle mismatch between the lengthwise axes of the cable drum 4 and the drive flange 3 and/or the drive shaft 2 can be equalized. For this, according to FIG. 2*a*, a bearing surface 9*b* of the coupling element 9 is formed convex and outwardly arched at a bearing surface 3*a* of the mating drive flange 3.

In the alternative embodiment of FIG. 2*b*, the convex arching is formed at the bearing surface 3*a* of the drive flange 3. The corresponding convex archings of the bearing surfaces are indicated by the radius of convexity R in FIGS. 2*a* and 2*b*.

A coupling fashioned in this way is distinguished by simple construction and it enables a good equalization of resulting manufacturing and setup tolerances with compact size.

Changes and modifications in the specifically described embodiments can be carried out without departing from the principles of the invention which is intended to be limited only by the scope of the appended claims, as interpreted according to the principles of patent law including the doctrine of equivalents.

What is claimed is:

1. A hoisting device, comprising:

a drive unit having a motor and a transmission;

a drive shaft driven by said drive unit;

a drive flange secured to said drive shaft;

a cable drum connected to said drive flange, wherein the torque of said drive shaft can be transmitted by a coupling to said cable drum; and said coupling including at least one coupling element, said at least one coupling element substantially defined by a form fit between said drive flange and said cable drum, said at least one coupling element constructed from individual coupling segments having drive cams pointing generally radially inward and outward on both sides of said coupling segments, said driving cams engage with corresponding recesses of two adjoining structural parts that can be coupled together for the torque transmission;

wherein said coupling segments extend essentially between said drive flange and said cable drum, outside of said drive cams.

2. The hoisting device of claim 1, wherein said coupling segments have pieces extending in two dimensions from said drive cams forming said bearing surfaces.

3. The hoisting device of claim 2, wherein said cable drum is mounted on said drive flange by said pieces of said coupling segments.

4. The hoisting device of claim 2, wherein said individual coupling segments extend around said drive cams on both sides of said cams.

5. The hoisting device of claim 3, wherein said individual coupling segments extend around said drive cams on both sides of said cams.

6. The hoisting device of claim 5, wherein said individual coupling segments extend in a circular arc between said drive flange and said cable drum.

7. The hoisting device of claim 6, wherein individual coupling segments are joined together by elastic connectors.

8. The hoisting device of claim 6, wherein individual coupling segments can be coupled together by molded-on projections and correspondingly fashioned seats.

9. The hoisting device of claim 6, wherein said at least one coupling element includes individual coupling segments arranged at a distance from each other.

10. The hoisting device of claim 9, wherein each coupling segment has drive cams pointing radially outward on both sides, each of said drive cams engage with corresponding recesses of two adjoining structural parts being coupled together for torque transmission.

11. The hoisting device of claim 10, wherein said drive cams are arranged directly opposite each other and pointing radially outward and inward.

12. The hoisting device of claim 11, wherein said drive cams are made at least partly of a harder material than the rest of said coupling element.

13. The hoisting device of claim 12, wherein said drive cams contain a shear-resistant core.

14. The hoisting device of claim 13, wherein said recesses are fashioned larger, looking in the axial direction of said cable drum, than the corresponding drive cams being accommodated.

15. The hoisting device of claim 14, wherein at least one bearing surface of said coupling element on one of the structural parts being coupled together and/or at least one bearing surface of a structural part being coupled on the coupling element is fashioned convexly arched outward.

16. The hoisting device of claim 15, wherein at least one coupling element is made at least partly of an elastic material.

17. The hoisting device of claim 16 wherein said elastic material is a plastic material.

18. The hoisting device of claim 1, wherein said individual coupling segments extend around said drive cams on both sides of said cams.

19. The hoisting device of claim 1, wherein said individual coupling segments extend in a circular arc between said drive flange and said cable drum.

20. The hoisting device of claim 1, wherein individual coupling segments are joined together by elastic connectors.

21. The hoisting device of claim 1, wherein individual coupling segments can be coupled together by molded-on projections and correspondingly fashioned seats.

22. The hoisting device of claim 1, wherein said at least one coupling element includes individual coupling segments arranged at a distance from each other.

23. The hoisting device of claim 1, wherein each coupling segment has drive cams pointing radially outward on both sides, each of said drive cams engage with corresponding recesses of two adjoining structural parts being coupled together for torque transmission.

24. The hoisting device of claim 23, wherein said recesses are fashioned larger, looking in the axial direction of said cable drum, than the corresponding drive cams being accommodated.

25. The hoisting device of claim 1, wherein said drive cams are arranged directly opposite each other and pointing radially outward and inward.

26. The hoisting device of claim 1, wherein said drive cams are made at least partly of a harder material than the rest of said coupling element.

27. The hoisting device of claim 1, wherein said drive cams contain a shear-resistant core.

28. The hoisting device of claim 1, wherein at least one bearing surface of said at least one coupling element on one of the structural parts being coupled together and/or at least one bearing surface of a structural part being coupled on the coupling element is fashioned convexly arched outward.

29. The hoisting device of claim 1, wherein said at least one coupling element is made at least partly of an elastic material.

30. The hoisting device of claim 29 wherein said elastic material is a plastic material.

* * * * *